United States Patent [19]

Niinomi et al.

[11] 4,356,751

[45] Nov. 2, 1982

[54] ELECTRONIC MUSICAL INSTRUMENT

[75] Inventors: Naoyuki Niinomi; Kunihiko Watanabe, both of Hamamatsu, Japan

[73] Assignee: Nippon Gakki Seizo Kabushiki Kaisha, Shizuoka, Japan

[21] Appl. No.: 149,885

[22] Filed: May 14, 1980

[30] Foreign Application Priority Data

May 19, 1979 [JP] Japan ..... 54-61872

[51] Int. Cl.[3] ..... G10F 1/00

[52] U.S. Cl. ..... 84/1.03; 84/124

[58] Field of Search ..... 84/1.01, 1.24, 1.03, 84/345

[56] References Cited

U.S. PATENT DOCUMENTS 3,992,969 11/1976 Robinson et al. ..... 84/1.17 X 4,106,383 8/1978 Dittmar ..... 84/1.24

4,132,904 2/1979 Harari ..... 365/228 X 4,148,017 4/1979 Tomisawa ..... 340/365 S 4,244,264 1/1981 Fellot ..... 84/345

*Primary Examiner*—J. V. Truhe

*Assistant Examiner*—Forester W. Isen

*Attorney, Agent, or Firm*—Townsend and Townsend

[57] ABSTRACT

An electronic musical instrument comprises a musical tone production circuit responsive to a depressed key among a plurality of keys, and a control circuit for controlling tone production manner which includes a plurality of manually operated members mounted on a control panel for setting parameters that determine the tone production manner. There is also provided presetting means for presetting some of the parameters. At an initial state after the instrument is powered from a power source, the preset parameters dominate the corresponding ones of the manually set parameters, while the preset parameters can be replaced by the manually set parameters at a choice of a player after powering.

4 Claims, 9 Drawing Figures

ELECTRONIC MUSICAL INSTRUMENT

BACKGROUND OF THE INVENTION

This invention relates to an electronic musical instrument of the type wherein such various characteristics of the musical tones generated as the color, volume and effect are controlled by the manipulation of a plurality of volume adjusting members, switches or the like mounted on the surface of a control panel, and more particularly an electronic musical instrument which can be readily played or performed by a novice player by making inoperative some one of a plurality of operating members, if desired, or by enabling a control based on preset information.

In a prior art electronic musical instruments, for example an organ, only tone levers (tone volumes) were provided to control tone color and footage for each keyboard but in a modern electronic musical instrument, as a result of developments in digital techniques such performances as automatic rhythm, automatic bass/chord, automatic arpeggio, etc. are added and switches, volume adjusting members or the like are also mounted on the surface of the control panel in addition to the tone levers. For this reason, the number of the operating members mounted on the panel surface has been increased to 100 or more so that such a high grade electronic musical instrument is difficult to play for an unskilled player.

SUMMARY OF THE INVENTION

Accordingly, a primary object of this invention is to provide an improved electronic musical instrument which can be readily played even by an unskilled player.

Another object of this invention is to provide an electronic musical instrument capable of being readily played by merely manipulating some ones among a plurality of operating members mounted on the panel surface.

Still another object of this invention is to provide a novel electronic musical instrument capable of concealing some of the operating members from the panel surface when a unskilled player plays the electronic musical instrument.

These and further object of this invention can be accomplished by providing an electronic musical instrument comprising a keyboard having a plurality of keys, means for controlling manners of tone production, and means coupled to the control means for forming a musical tone corresponding to a depressed key, the control means including a plurality of manually operated members for settings parameters that determine the manners and mounted on a control panel, means for presetting a predetermined one of elements corresponding to a parameter that can be set by the manually operated members, means for coupling a preset value to the musical tone forming means when a power source is closed and means for substituting a manually controlled value for the preset value coupled to the musical tone forming means after closure of the power source.

DESCRIPTION OF THE PREFERRED EMBODIMENTS

Figure 1:
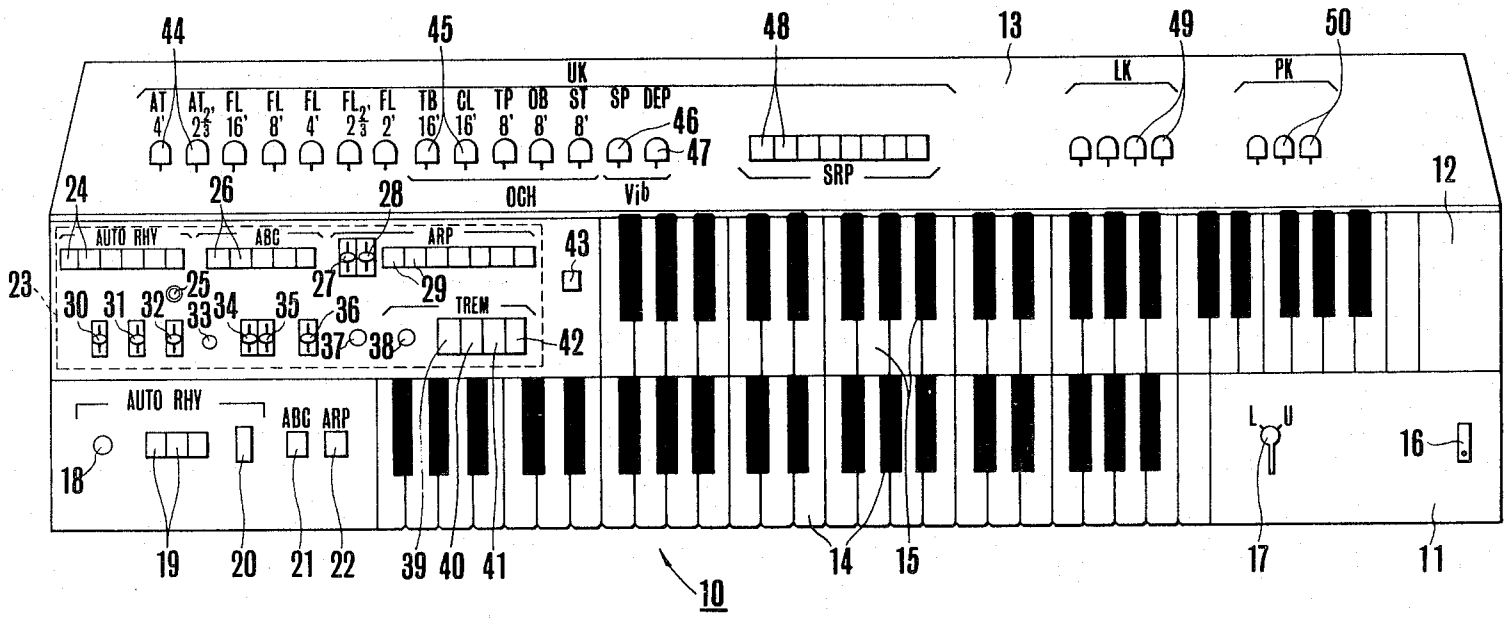
FIG. 1 is a front view of an electronic musical instrument embodying the invention.

As shown in FIG. 1, one embodiment of the electronic musical instrument of this invention comprises a main body 10, a lower stage panel 11, a middle stage panel 12 and an upper stage panel 13.

Figure 2:
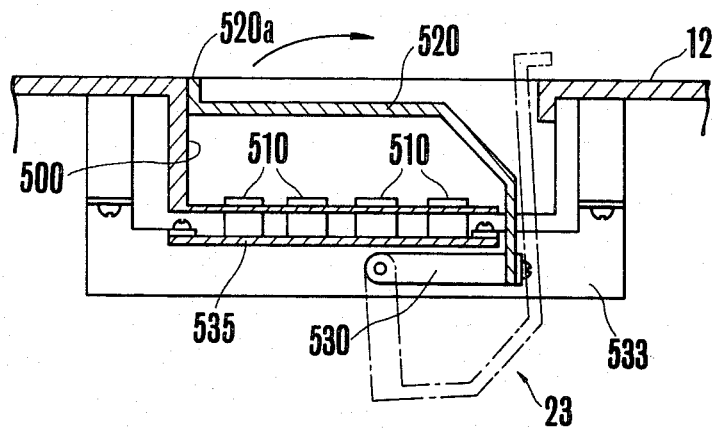
FIG. 2 is a sectional view showing the construction of a blind unit shown in FIG. 1.

A lower keyboard (LK) 14 is mounted on the lower stage panel 11 and an upper keyboard (UK) 15 is mounted on the middle stage panel 12. In addition, a plurality of operating members are mounted on these panels. More particularly, on the right hand portion of the lower panel 11 are mounted a source switch 16 and a U(UK)/L(LK) manual balancing variable resistor 17, whereas on the left hand portion of the lower panel 11 are mounted a tempo adjusting variable resistor 18 of an automatic rhythm performance (auto-rhythm), three rhythm selection switches 19 for selecting such extremely simple (small) variation rhythm patterns as two beats or double meter, three beats or tripe meter, four beats or quadruple meter and the like, a switch 20 for instructing starting of an auto-rhythm, a switch 21 for designating preset automatic bass/chord (ABC) of a simple form, and a switch 22 for designating a preset automatic arpeggio arpeges (ARP) of a simple form. On the left hand of the middle step panel 12 is mounted a blind unit 23 containing a plurality of operating members 24 through 42 which are not used for an ordinary performance except in a special case, and a preset release switch 43. The construction of the blind unit 23 may be of any well known type so long as it can "blind" or conceal the parts contained therein. For example, it may comprise a hinged lid, a slidable lid, or a rotatable triangular or square pillar on which switches and volume control members are mounted. For the sake of brevity, in FIG. 1 the blind unit 23 is shown as bounded by dash lines. One example of the hinged lid type is shown in FIG. 2 in which a flat panel 12 is formed with a recess 500, and a plurality of operating members and switches 510 described above are disposed at the bottom of the recess 500. The upper opening of the recess 500 is normally closed by a cover 520 which has a letter L cross-sectional configuration and can be opened to a dotted line position by pulling a handle in a direction shown by an arrow so as to enable the manipulation of switches contained in the recess. Arms 530 and 531 are connected to both corners on the side opposite to the handle 520*a* of the cover 520, the opposite ends of these arms being pivotally connected to frames or other suitable supporting members 533 and 534 extending the parallel therewith and secured to the panel 12 (arm 531 and member 534 are not shown because they are positioned in front of the sheet of drawing). In this example the operating members and switches 510 are mounted on a base plate 535 extending between the frames 533 and 534 on the back of the recess 500.

Figure 3:
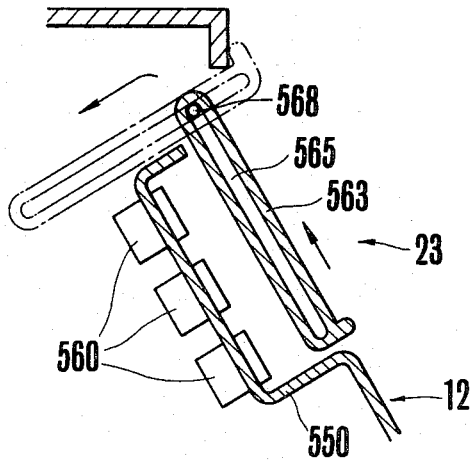
FIG. 3 is a sectional view showing a modified construction of the blind unit shown in FIG. 2.

FIG. 3 shows one example of a slidable lid in which a blind unit 23 includes recess 550 formed in an inclined panel 12 and the operating members and the switches 560 are secured to the bottom of the recess. In the flat opposing side surfaces of the upper openings of the recess are formed a pair of guide grooves 565 and 566 extending in the direction of width of the recess to slidably receive a lid or cover 563. A pair of pins 568 and 569 extending from the panel or frame are received in the guide grooves (since groove 566 and pin 569 are disposed on the rear side of the sheet of drawing they are not shown). The cover 563 is normally in the closed position shown by solid lines. To open the recess, the cover 563 is swung to the dotted line position to enable manipulation of the switches 560.

The operating members included in the blind unit 23 comprise six switches 24 (one of which is used for cancellation) and a volume adjusting and balancing variable resistor 25 regarding the auto-rhythm (AUTO RHY); five switches 26 for selecting an operating mode regarding the auto-base/chord (ABC), a sustain length adjusting variable resitor 27, a volume adjusting variable resistor 28 and seven operating selection switches (one of which is used for cancellation) regarding the autoarpeges (ARP); a UK tone attack adjusting variable resistor 30, a delay time adjusting variable resistor 31 regarding the vibrato, a volume adjusting variable resistor 32 and a U/L transfer switch 33 regarding a special preset, a UK sustain length adjusting variable resistor 34, a PK tone sustain length adjusting variable resistor 35, a reverbe tone adjusting variable resistor 36, a variable resistor 37 (for master volume control), a modulation speed controlling variable resistor 38 for the tremolo effect (TREM), a modulation speed (SLOW or FAST) setting switch 39, a LK tone designation switch 40, an orchestra UK tone designation switch 41 and a flute UK tone designation switch 42.

These control members 24 through 42 can not be operated when the blind unit 23 is blinded or closed so as to conceal the inside, and when the blind unit 23 is opened their operations are made ineffective unless a preset release switch 43 is closed to release the preset states. More particularly, when the preset is not released (i.e. in the case of the preset mode) the automatic rhythm performance (auto-rhythm), the automatic bass/chord performance (auto-bass/chord) or the automatic arpeggio performance (auto-arpeggio) can be performed with a relatively simple preset mode by suitably manipulating the operating members 18 through 22 mounted on the lower stage panel 11 and the musical tone can be controlled in accordance with preset information to be described later. However, it is impossible to control the musical tone in accordance with control information set in the blind unit 23. To enable such control it is necessary to manually release (transfer to the manual mode) the preset as will be described later in detail with reference to FIGS. 4 and 5.

On the upper panel 13 are mounted, seven tone volume adjusting variable resistors 44 and five orchestra (OCH) tone volume adjusting variable resistors 45 regarding the UK tone, a speed (SP) adjusting variable resistor 46 and a depth (DEP) adjusting variable resistor 47 regarding the vibrato effect, eight selection switches 48 (one of which is used for cancelling) data regarding a special preset (SPR) tone, four tone volume adjusting variable resistors 49 regarding the LK tone, and three tone volume adjusting variable resistors 50 regarding a pedal keyboard (PK) tone. Volume control members 44 for the UK tone are provided on an attack 4 feet AT4', an attack $2\frac{2}{3}$ feet AT $2\frac{2}{3}$', a flute 16 feet FL16', a flute 8 feet FL8', a flute 4 feet FL4', a flute $2\frac{2}{3}$ feet FL$2\frac{2}{3}$' and a flute 2 feet FL2', whereas the tone volume control members 45 for the orchestra UK tone are provided a tromebone 16 feet TB16', a clarinetto 16 feet CL16', a trumpet 8 feet TP8', an oboe 8 feet OB8', and strings 8 feet 8T8'. Among the preset tones selectable by the selection switch 48 may be mentioned a piano, a harpsichord, a guitar, a biblaphone, an accordion, a banjo and a mandolin. Furthermore, as the LK tone volume control members 49 are provided those relating to a piano I, a piano II, a guitar and a harpsichord, and as the PK tone adjusting tone volume control member 50 are provided those relating to a base 16', a bass 8' and a base guitar. Thus, the performer can set any desired tone color by suitably manipulating those operating members 44 through 50.

The circuit construction of the electronic musical instrument of this invention will be described with reference to FIGS. 4 and 5.

Figure 4:
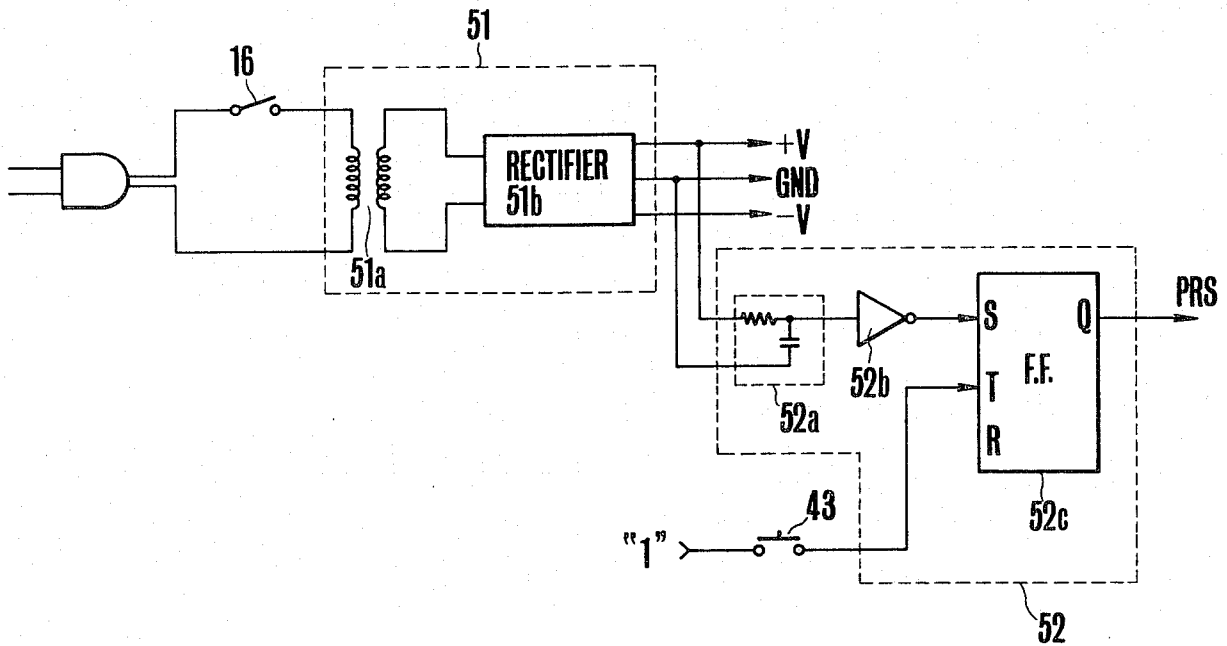
FIG. 4 is a connection diagram showing one example of the source circuit and the preset signal forming unit shown in FIG. 1.

FIG. 4 shows a source circuit 51 for supplying voltages ±V and a ground potential GND to various parts of the electronic musical instrument and a preset signal forming circuit 52 which forms a preset signal PRS. The source circuit 51 may be of a well known type. In this example, an AC signal supplied through a plug and a source switch 16 is transformed by a transformer 51*a*, and the output voltage of the transformer is rectified by a rectifier 51*b* to obtain the voltages ±V and the ground potential GND.

The preset signal forming circuit 52 is constituted by an R-C integrator 52*a* with its inputs supplied with the voltage +V and the ground potential GND, an inverter 52*b* for inverting the output of the integrator 52*a*, and a flip-flop circuit 52*c* supplied with the output of the inverter 52*b* to its set terminal. To the trigger input T of the flip-flop circuit 52*c* is applied a "1" or "0" state signal from a preset release switch 43 in the form of a self returning type push button switch. Further, the flip-flop circuit 52*c* produces a preset signal PRS from its Q output.

When the source switch 16 is closed and unless the preset release switch 43 is closed, the preset signal PRS is "1" whereas the signal becomes "0" when the switch 43 is closed once, and returns to "1" when the switch 43 is closed again. The preset signal PRS is applied to the musical tone forming and controlling unit shown in FIGS. 5A and 5B for switching its operation mode. As a consequence, the source switch 16 and the preset release switch 43 operate as an operation mode instruction switch. More particularly, when the source switch 16 alone is closed, the preset signal PRS is "1" so that the control information generated by the manipulation of the operating members 24 through 42 of the blind unit 23 is invalid thus enabling the musical tone control based on the preset information (this is called the preset mode). On the other hand, when the preset release switch 43 is closed once following the closing operation of the source switch 16, the preset signal PRS becomes "0" thus releasing the preset mode described above so that the musical tone control caused by the operation of the operating members 24 through 42 of the blind unit 23 becomes possible. This is called a manual mode. When the preset release switch 43 is closed again, the preset signal PRS returns to "1" as above described, thus switching from the manual mode to the preset mode.

Figure 5A:
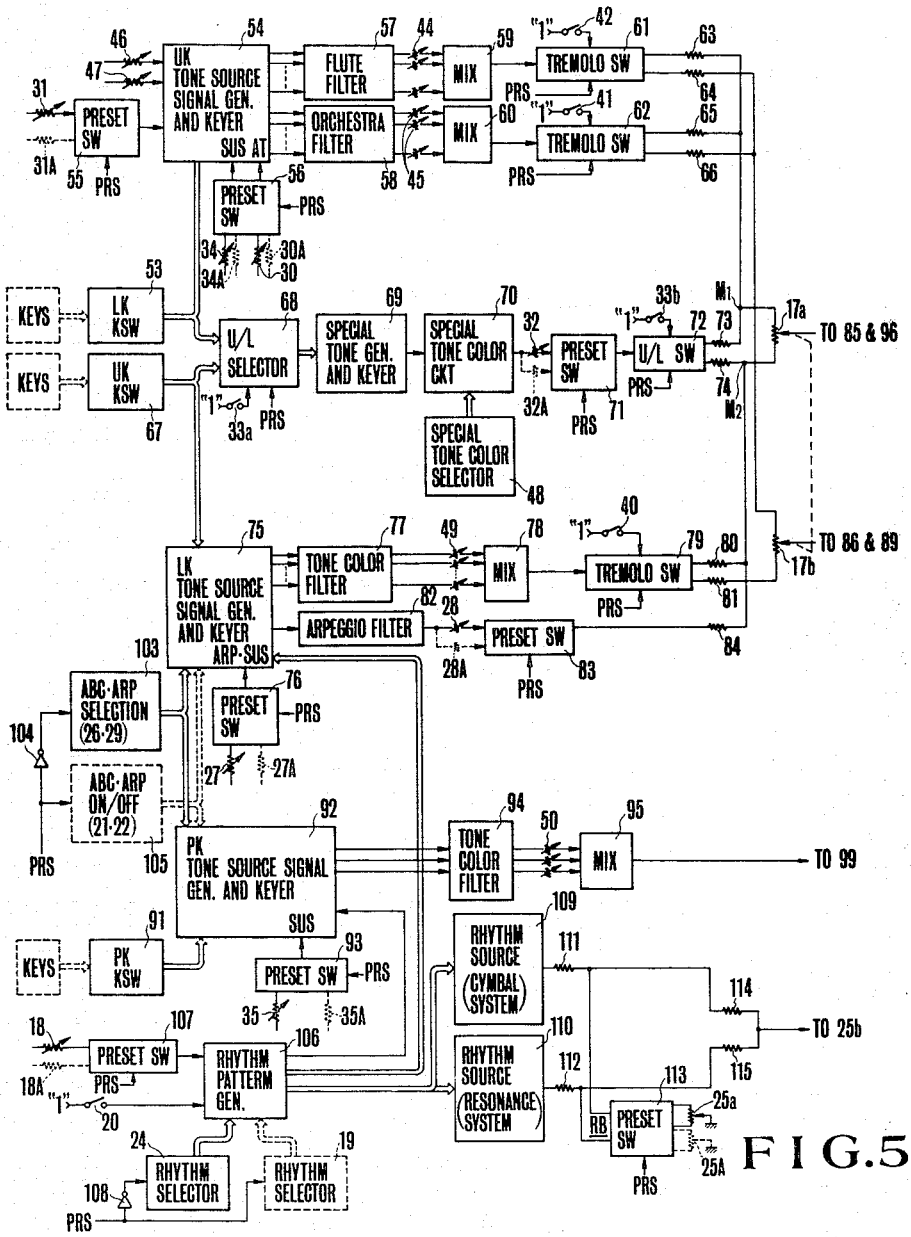
FIG. 5A and 5B are connection diagrams showing the detail of one example of a musical tone forming and controlling unit of the electronic musical instrument shown in FIG. 1.
Figure 5B:
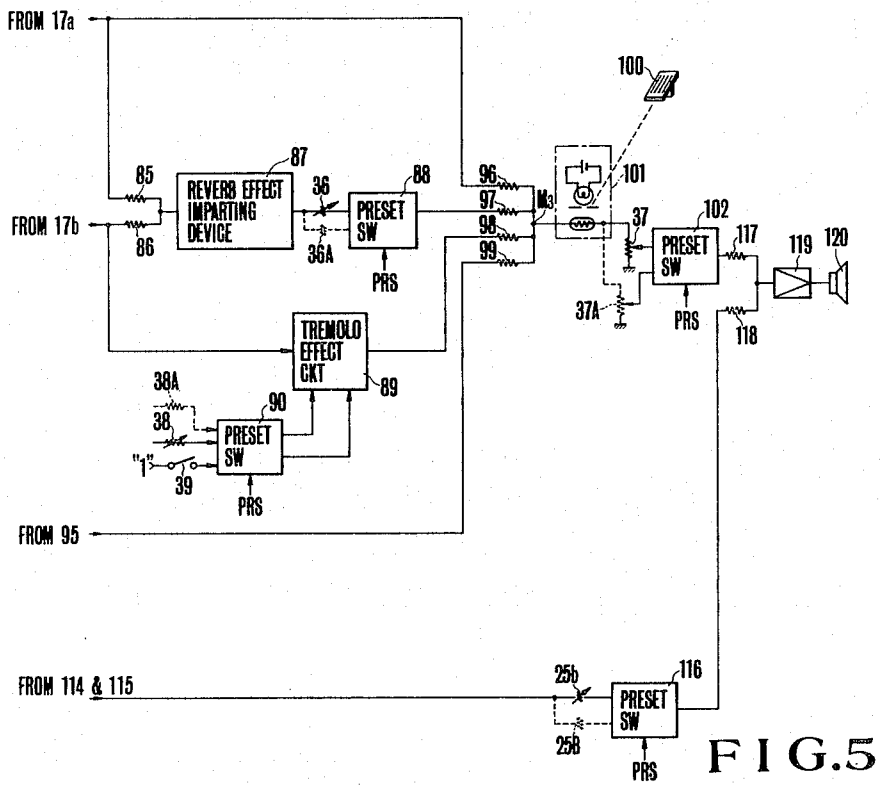

The detail of the musical tone forming and the controlling unit shown in FIGS. 5A and 5B will now be described. It comprises a key switch (KSW) circuit corresponding to the upper keyboard (UK) 15 which applies a key state signal representing a depressed key to a tone source signal generation circuit and keyer 54 which comprises a tone source unit generating a tone source signal having a frequency corresponding to all keys of the upper keyboard, and a switch unit which passes or blocks the tone signal from the tone source unit in accordance with the key state signal from the key switch circuit 53. Furthermore, the tone source unit is provided with a vibrato effect circuit that generates a vibrato modulation low frequency signal having a frequency set by the vibrato speed adjusting variable resistor 46 and an amplitude set by the vibrato depth adjusting variable resistor 47 for enabling to provide a vibrate effect by frequency modulating the tone source signal with this low frequency signal. Provision of the vibrato effect at a time later than a predetermined interval after the initiation of the key depression is controlled by the output signal from a preset switch circuit 55 which is constructed to produce a voltage signal from the variable resistor 31 or a presetting fixed resistor 31A mounted on the panel surface. For this reason, in the case of the preset mode in which the preset signal PRS is "1", the vibrato delay time is determined by a preset voltage supplied from the presetting fixed resistor 31A. On the other hand, in the case of the manual mode wherein the preset signal PRS is "0" the vibrato delay time is determined by a voltage set by the variable resistor 31 on the panel surface.

By a switch in the tone source signal generation circuit and keyer 54, are also controlled the attack time AT and the sustain time SUS of the opening and closing envelope according to the output signal of the preset switch circuit 56. In the case of the preset mode in which the preset signal PRS is "1", the preset switch circuit 56 produces the voltage signal from the presetting fixed resistors 30A and 34A, whereas in the manual mode in which the preset signal PRS is "0" produces the voltage signal from the vaiable resistors 30 and 34 on the panel surface. For this reason, in the case of the preset mode, the lengths of the attack time AT and the sustain time SUS are determined by the voltages from the fixed resistors 30A and 34A respectively whereas in the case of the manual mode these lengths are determined by the voltages from the variable resistors 30 and 34 respectively.

Depending on the footage, the output signal of the tone source signal generation circuit and keyer 54 is supplied to a flute tone color filter circuit 57 and an orchestra tone color filter circit 58. The filter circuit 57 forms 16′, 8′, 4′, 2⅔′ and 2′ flute tone colors and 4′ and 2⅔′ attack tone color whereas the filter circuit 58 forms tronbone and clarinetto tone colors of 16′ and trumpet, oboe and strings tone colors of 8′. The musical tone signal from the filter circuit 57 is applied to a mixer 59 via tone volume controlling variable resistors 44 provided for respective tone colors. Also the musical tone signal from the filter circuit 58 is supplied to a mixer 60 via tone volume controlling variable resistors 45 provided for respective tone colors. The mixers 59 and 60 mix together musical tone signals respectively inputted thereto for providing mixed outputs to tremolo switching circuits 61 and 62.

Respective tremolo effects are produced in accordance with the preset signal PRS. Thus, in the case of the preset mode in which the preset signal PRS is "1" these switching circuits 61 and 62 respectively produce a flute musical tone signal and an orchestra musical tone signal via resistors 63 and 65 respectively, whereas in the case of the manual mode in which the preset signal PRS is "0", these circuits produce a flute musical tone signal and an orchestra musical tone signal via resistors 64 and 66 respectively when the designating switches 42 and 41 are closed. Where the switches 42 and 41 are not closed, the tremolo switching circuits 61 and 62 produce respective musical tone signals via resistors 63 and 65. More particularly, in the case of the preset mode, non impartion of the tremolo effect is automatically selected, which in the case of the manual mode impartion of the tremolo effect can be selected. However, whether the tremolo effect is to be imparted or not is determined by the state of the designation switch 41 or 42.

Turning now to the description of a circuit for forming a special musical tone, a key state signal from the UK key switch circuit 53 is applied to one input of a U/L selector 68, the other input thereof being supplied with a key state signal from a key switch circuit corresponding to the lower keyboard (LK) 14. In the preset mode wherein the preset signal PRS is "1", the selector 68 derives out a key state signal from the UK key switch circuit 53 independently of the operation of the U/L transfer switch 33, whereas in the case of the manual mode wherein the preset signal PRS is "0", the selector 68 derives out a key state signal from the UK key switch circuit 53 or a key state signal from the LK key switch circuit 67 in accordance with a state signal "0" or "1" from one (in this case **33*a*) of a pair of mutually interlocked switch elements 33*a* and 33*b* of the U/L transfer switch 33. The key state signal sent out from the selector 68 is applied to a special tone signal generation circuit and keyer 69**.

The special tone signal generation circuit or and keyer 69 is constructed to produce a tone signal corresponding to a depressed key of the upper or lower (UK or LK) keyboard and the tone signal thus produce is supplied to a special tone color circuit 70 to form a tone color. The tone color forming mode of the special tone color circuit 70 is controlled by the tone color selection switch 48 so that it can form tone color of a piano, a harpsichord, a guitar, a vibraphone, an accordian, a banjo, a mandolin, etc. Accordingly, the special tone color circuit 70 produces a musical tone signal of a tone color designated by the tone color selection switch 48 and the musical tone signal thus produced is supplied to a preset switching circuit through parallel connect volume adjusting variable resistor 32 and the presetting fixed resistor 32A mounted on the panel surface.

The preset transfer circuit 71 operates to select a musical tone signal from resistor 32 or 32A according to the preset signal PRS. In the case of the preset mode wherein the preset signal PRS is "1", the preset transfer circuit 71 derives out the musical signal from the fixed resistor 32A, while in the case of the manual mode wherein the preset signal PRS is "0" derives out the musical signal from the variable resistor 32. The musical tone signal derived out from the preset transfer circuit 71 is applied to a U/L switching circuit 72.

The U/L switching circuit 72 sends out an inputted musical tone signal via a resistor 73 in the case of the preset mode wherein the preset signal PRS is "1" whereas in the case of the manual mode wherein the preset signal PRS is "0" circuit 72 produces an inputted musical signal via resistors 73 or 74 when the state signal is produced by the switch element 33*b* interlocked with the switch element 33*a*. Thus, the switching operation of the U/L switching circuit 72 corresponds to that of the U/L selector 68 described above. More particularly, in the case of the preset mode or the manual mode, where the switch elements 33*a* and 33*b* are off, the U/L switching circuit 72 produces a special musical tone signal regarding the upper key UK via the resistor 73 when the U/L selector 68 selects a UK key state signal. On the other hand during the manual mode, when the switch elements 33*a* and 33*b* are closed, as the U/L selector 68 selects an LK key state signal the U/L switching circuit 72 produces a special musical tone signal regarding the lower keyboard LK via a resistor 74. The UK special musical tone signal derived out through the resistor 73 is mixed with the UK musical tone signal from the above described resistors 63 and 65, while the LK special signal derived out from the resistor 74 is mixed with an LK musical signal to be described later.

Considering an LK musical tone forming circuit, a tone source signal generation circuit and keyer 75 supplied with a key state signal from an LK key switch circuit 67 comprises a tone source which generates a tone source signal having a frequency corresponding to all keys of the lower keyboard LK and a switch member for passing or blocking a tone source signal from the tone source in accordance with the key state signal from the key switch circuit 67, an auto-bass/chord circuit and an auto-arpeggio circuit. When performing an arpeggio, the length of the sustain time (ARP.SUS) of the envelope is controlled by the output signal from a preset switching circuit 76 that produces a voltage signal from the variable resistor 27 on the panel surface or the presetting fixed register 27A. As a consequence, in the case of the preset mode in which the preset signal PRS is "1", the arpeggio sustain time (ARP.SUS) is determined in accordance with a voltage from the fixed resistor 27A, whereas in the case of the manual mode wherein the preset signal PRS is "0" the arpeggio sustain time (ARP.SUS) would be determined in accordance with the voltage from the variable resistor 27.

The output signal from the tone source signal generation circuit and keyer 75 is supplied to a tone color filter circuit 77 where it is applied with the tone colors of a piano I, a piano II, a guitar and a harpsichord. On the output side of the tone color filter circuit 77 are provided tone volume adjusting variable resistors 49 for respective tone colors so that the musical tone signal produced by the tone color filter circuit 77 is supplied to and mixed by a mixer 78 via these tone volume adjusting variable resistors 49, and the musical tone signal produced by the mixer 78 is supplied to a tremolo switching circuit 79.

A tremolo switching circuit 79 is similar to the aforementioned tremolo switching circuits 61 and 62, and sends out a musical tone signal via a resistor 80 in the case of the preset mode wherein the preset signal PRS is "1" whereas in the case of the manual mode wherein the preset signal is "0" the tremolo switching circuit 79 produces a musical signal through a resistor 81 when the designation switch 40 is ON but through the resistor 80 when the designation switch 40 is off.

When performing an arpeggio, the tone source signal generation circuit 75 produces an arpeggio keying output signal whose tone color is formed by an arpeggio filter circuit 82. The musical tone signal from this filter circuit 82 is supplied to a preset switching circuit 83 in parallel through a volume adjusting variable resistor 28 mounted on the panel surface and a presetting fixed resistor 28A.

In response to the preset signal PRS, a preset switching circuit 83 selectively derives out the musical tone signal from the resistor 28 or 28A. Thus, in the case of the preset mode wherein the preset signal PRS is "1", the preset switching circuit 83 sends out the musical tone signal from the fixed resistor 28A via a resistor 84, whereas in the case of the manual mode wherein the preset signal PRS is "0" circuit 82 sends out the musical tone signal from the variable resistor 28 through a resistor 84.

Any one of the flute UK musical tone signal sent out through the resistor 63 the orchestra UK musical tone signal sent out through the resistor 65 and the UK special musical tone signal sent out through a resistor 73 is not intended to impart a tremolo effect and these musical tone signals are mixed together at a mixing point $M_1$ and the mixed signal is supplied to one end of one (in this example, 17*a*) of a pair of mutually interlocked resistance elements 17*a* and 17*b* of the manually balancing variable resistor 17. In the same manner, any one of the LK special musical tone signal sent out through resistor 74, the LK musical tone signal sent out through resistor 80 and the arpeggio musical tone signal sent out through resistor 84 is not intended to impart the tremolo effect so that these musical tone signals are mixed together at a mixing point $M_2$ and then supplied to the other terminal of the resistance element 17*a*. For this reason, the musical tone signal from the mixing point $M_1$ and the musical tone signal from the mixing point $M_2$ are mixed together at the resistance element 17*a*.

On the other hand, each of the flute UK musical tone signal sent out through resistor 64, the orchestra UK musical tone signal sent out through resistor 66 and the LK musical tone signal sent out through resistor 81 is intended to impart the tremolo effect so that these musical tone signals are mixed together at the other resistance element 17*b* of the variable resistor 17.

The ratio of mixing the UK and LK musical tone signals at the resistance elements 17*a* and 17*b* is determined by the position of a movable contact for deriving out a mixed output so that it is possible to make one of the UK musical tone and the LK musical tone to be higher than the other or to make equal both tones.

Mixed musical tone signals respectively derived out from the resistance elements 17*a* and 17*b* are supplied to a reverb device as a mixture respectively through resistors 85 and 86. The reverb device imparts a reverberation characteristic to the musical tone signal. The musical tone signal outputted from the reverb device 87 is applied to a preset switching circuit 88 in parallel through the volume adjusting variable resistors 36 on the panel surface and the presetting fixed resistors 36A.

The preset switching circuit 88 selectively derives out the musical tone signal from the resistors 36 or 36A in accordance with the preset signal PRS. Thus, in the case of the preset mode in which the preset signal PRS is "1" the preset switching circuit 88 derives out the musical tone signal from the fixed resistor 36A, while in the case of the manual mode wherein the preset signal PRS is "0", it derives out the musical tone signal from the variable resistor 36.

The mixed musical tone signal derived out from the resistance element **17*b* is also supplied to a tremolo effect circuit 89 where it is amplitude-modulated by a tremolo modulation low frequency signal to impart the tremolo effect. The tremolo circuit 89 is constructed such that the frequency of the tremolo modulation low frequency signal is controlled by the output signal from a preset switching circuit 90 so as to set the modulation speed of the tremolo. In other words, the preset switching circuit 90 whose switching operation is controlled by the preset signal supplies the voltage from the presetting fixed resistor 38A to the tremolo effect circuit 89 in the case of the preset mode wherein the preset signal PRS is "1" so as to obtain a definite tremolo modulation speed corresponding to the voltage described above. And in the case of the manual mode wherein the preset signal is "0", the preset switching circuit 90 supplies the control signal from the variable resistor 38 and the switch 39 on the panel surface to the tremolo effect circuit 89 so as to obtain various tremolo modulation speeds corresponding to the control signal. The modes of control are such that the switch 39 is opened to set a slow mode and the variable resistor 38 is set to a desired value, and such that the switch 39 is opened to set a fast mode and the variable resistor 38** is set to a desired value.

A key switch circuit 91 corresponding to a pedal keyboard (PK), sends a key state signal representing a depressed pedal key to a tone source signal generation circuit and keyer 92 which is constituted by a tone source unit which produces a tone source signal of a frequency corresponding to all keys, a switch unit for deriving out the tone source signal from the tone source unit according to a key state signal produced by the key switch circuit 91, an auto-bass/chord circuit and an auto-arpeggio circuit. When the switching unit is operated, the length of the sustain time of the envelope is controlled by the output signal of the preset switching circuit 93 which selectively outputs the voltage of the variable reistor 35 or presetting fixed resistor 35A in accordance with the preset signal PRS. For this reason, in the case of the preset mode wherein the preset signal PRS is "1" the sustain time SUS is determined by the voltage from the fixed resistor 35A, whereas in the case of the manual mode in which the preset signal PRS is "0", the sustain time is determined by the voltage set by the variable resistor 35.

The output signal produced by the tone source signal generation circuit and keyer 92 is supplied to a tone color filter circuit 94 to form such tone colors as a bass 16', a bass 8', a base quitar, etc. The musical tone signal produced by the tone color filter circuit 94 is applied to a mixer 95 via tone volume adjusting variable resistors 50 provided for respective tone colors.

Aforementioned mixed musical tone signal derived out from the resistance element **17*a* and a reverb imparting musical tone signal sent out from the preset switching circuit 88, a tremolo imparting musical tone signal produced by the tremolo effect circuit 89 and the mixed musical signal sent out from the mixer 95 are applied to a mixing point $M_3$ respectively through resistors 96, 97, 98 and 99. A mixed musical tone signal produced by the mixing point $M_3$ is supplied to an expression device 101 operated by an expression pedal 100 so as to control the tone volume in accordance with the depression angle of the expression pedal 100**.

The musical tone signal produced by the expression device 100 is applied to a preset switching circuit 102 in parallel through the master volume adjusting member 37 and the presetting fixed resistor 37A. The preset switching circuit 102 operates to switch the signal according to the preset signal PRS. Thus, in the case of the preset mode in which the preset signal PRS is "1" the musical tone signal from the fixed resistor 37A is derived out whereas in the case of the manual mode in which the preset signal is "0", the musical tone signal from the master volume adjusting member 37 is derived out.

With reference to the LK tone source signal generation circuit and keyer 75 and the PK tone source signal generation circuit and keyer 92, an auto-bass/chord (ABC) circuit and an auto-arpeggio (ARP) circuit will now be described hereunder. An ABC/ARP selection circuit 103 is provided to supply to the tone source signal generation circuit and keyers 75 and 92 a mode designation signal that designates various ABC modes and ARP modes when the ABC mode selection switch 26 and the ARP mode selection switch 29 are operated. Among the designatable ABC modes are included one finger (which produces an auto-bass tone and an auto-chord tone by the depression of one key of the lower keyboard LK), custom (which produces auto-chord tone by depressing three keys of the lower keyboard LK), and an auto-base tone by depressing one key of the pedal keyboard PK), a finger chord (which produces an auto-bass tone and an auto-chord tone by the depression of three keys of the lower keyboard), and a constant (which sustains the chord tone and the bass tone and rhythmically changes them). The constant is divided into one finger and a fingered chord, and a memory which stores the newest LK depressed key after release thereof. Among the designatable ARP modes are included a up mode (that shifts toward the higher tone side), a turn mode (that shifts toward the lower tone side) and a up/turn mode (that repeats the rise and lower). The ABC/ARP selection circuit 103 is supplied with the preset signal PRS via an inverter 104. The selection circuit 103 does not send out a mode designation signal in the preset mode wherein the preset signal PRS is "1" but sends out a mode designation during the manual mode wherein the preset signal is "0". As a consequence, only in the manual mode, the auto-bass/chord tone and the auto-arpeggio tone can be performed by the manipulation of the selection switches 26 and 27 on the panel surface.

An ABC/ARP ON/OFF circuit 105 is provided to supply to the tone source signal generation circuit and keyers 75 and 92 a mode designation signal that designates a simple ABC mode and an ARP mode when the above described ABC designation switch 21 and the ARP designation switch 22 are operated. For example, it is possible to make settable the ABC mode by one finger mode and to make settable the ARP mode to the up mode. The operation of the ABC/ARP ON/OFF circuit 105 is controlled by the preset signal PRS and this circuit 105 sends out a mode designation signal in the case of the preset mode in which the preset signal PRS is "1" whereas circuit 105 does not send out the mode designation signal in the case of the manual mode wherein the preset signal is "0". For this reason, in the case of the preset mode, it is possible to perform the auto-bass/chord tone with the one finger mode by closing the ABC designation switch 21, and to perform the arpeggio tone with the up mode by closing the ARP designation switch 22.

A rhythm pattern generator 106 is provided to read out a rhythm pattern signal from a rhythm pattern memory device with a signal obtained by counting the number of tempo-clock signals, the timing of generation of the rhythm pattern signal being controlled by the start instruction switch 20. The frequency of the tempo clock signal, that is the tempo of the rhythm is controlled by the output signal of the preset switching circuit 107 which selectively sends out the voltage signal from the variable resistor 18 mounted on the panel surface or the presetting fixed resistor 18A. In the case of the preset mode wherein the preset signal PRS is "1" a voltage signal from the fixed resistor 18A is sent out whereas in the case of the manual mode in which the preset signal is "0", a voltage signal from the variable resistor 18 is sent out. For this reason, during the preset mode, a definite tempo would be set by the voltage from the fixed resistor 18A whereas during the manual mode various tempos would be set by the adjustment of the variable resistor 18.

A rhythm pattern to be generated by the rhythm pattern generator 106 is designated by the rhythm selection switch 19 or 24. In this example, the rhythm selection switch 24 is controlled by a signal produced by inverting the preset signal PRS with an inverter 108 and during the preset mode wherein the preset signal is "1" the rhythm selection switch 24 is disabled but enabled during the manual mode in which the preset signal is "0". On the other hand, the rhythm selection switch 19 is controlled by the preset signal PRS so that it is enabled during the preset mode wherein the preset signal is "1" but disabled during the manual mode in which preset signal is "0". Accordingly, in the case of the preset mode either one of the rhythm selection switches 19 and 24 is operated to select either one of such simple rhythm patterns as two beats, three beats and four beats. At the time of the manual mode, the rhythm selection switch 24 is suitably operated for selecting various rhythm patterns as waltz, mambo and samba.

The rhythm pattern signal generated by the rhythm pattern generator 106 is applied not only to the LK and PK tone signal generation circuit and keyers 75 and 92 but also to a cymbals system rhythm tone source circuit 109 and a resonance system tone source circuit 110. The rhythm pattern signal supplied to the LK and PK tone source signal generation circuit and keyers 75 and 92 is used to change the chord tone or bass tone into a rhythm when a constant mode is selected by the ABC-/ARP selection circuit 103. The rhythm pattern signal applied to the rhythm tone source circuits 109 and 110 drives these circuits to cause them to produce a cymbals system tone source signal and a resonance system tone source signal respectively.

The tone source signals generated by the rhythm tone source circuits 109 and 110 are applied through resistors 111 and 112 to a rhythm balancing circuit RB including the preset switching circuit 113 and balancing resistors **25*a* and 25A. The resistor 25*a* is one of the variable resistance elements of the rhythm tone volume adjusting and balancing variable resistor 25 described above, whereas the resistor 25A is a different presetting fixed resistor. A preset switching circuit 113 controlled by the preset signal PRS renders the fixed resistor 25A active to provide a balance control during the preset mode wherein the preset signal PRS is "1" renders the variable resistor 25*a* active to provide a balance control during the manual mode wherein the preset signal PRS is "0". The cymbals system tone source signal and the resonance system tone source signal subjected to such balance control are mixed together respectively through resistors 114 and 115 and the mixed signal is supplied to a preset switching circuit 116 in parallel through the other variable resistance element 25*b* of the above described variable resistor 25 and the presetting fixed resistor 25B**.

The signal switching operation of the preset switching circuit 116 is controlled by the preset signal PRS to produce a rhythm tone source signal from a fixed resistor 25B during the preset mode in which the preset signal is "1" and to produce a rhythm tone source signal from the variable resistance element **25*b***.

The musical tone signal outputted from the preset switching circuit 102 and the rhythm tone source signal outputted from the preset switching circuit 116 are admixed after passing through resistors 117 and 118 respectively and then applied to an output amplifier 110 to undergo power amplification. The mixed musical tone signal amplified by the output amplifier is supplied to an electro-acoustic converter 120 such as a loudspeaker to be produced as a musical tone.

With the electronic musical instrument described above it is possible to provide two types of performance of the preset mode and the manual mode. More, particularly in the case of the preset mode the control information produced by the manipulation of the control members 24 through 42 of the blind unit 23 is made invalid and the musical tone is automatically controlled based on a control information preset in the plurality of preset units shown by dotted lines in FIGS. 5A and 5B so that the manipulation to be made on the panel surface is greatly simplified which is especially advantageous for unskilled performers. In the case of the manual mode, instead of invalidating the preset control information, it becomes possible to utilize control information caused by the manipulation of various control members in the blind unit, so that skilled performers can enjoy performances by adding numerous variations.

The value of the presetting resistor shown by broken lines in FIG. 5 can be determined during the process steps of manufacturing. Although this resistor may be a permanently fixed resistor, a semifixed resistor is more advantageous from the stand point of adjustment.

Figure 6:
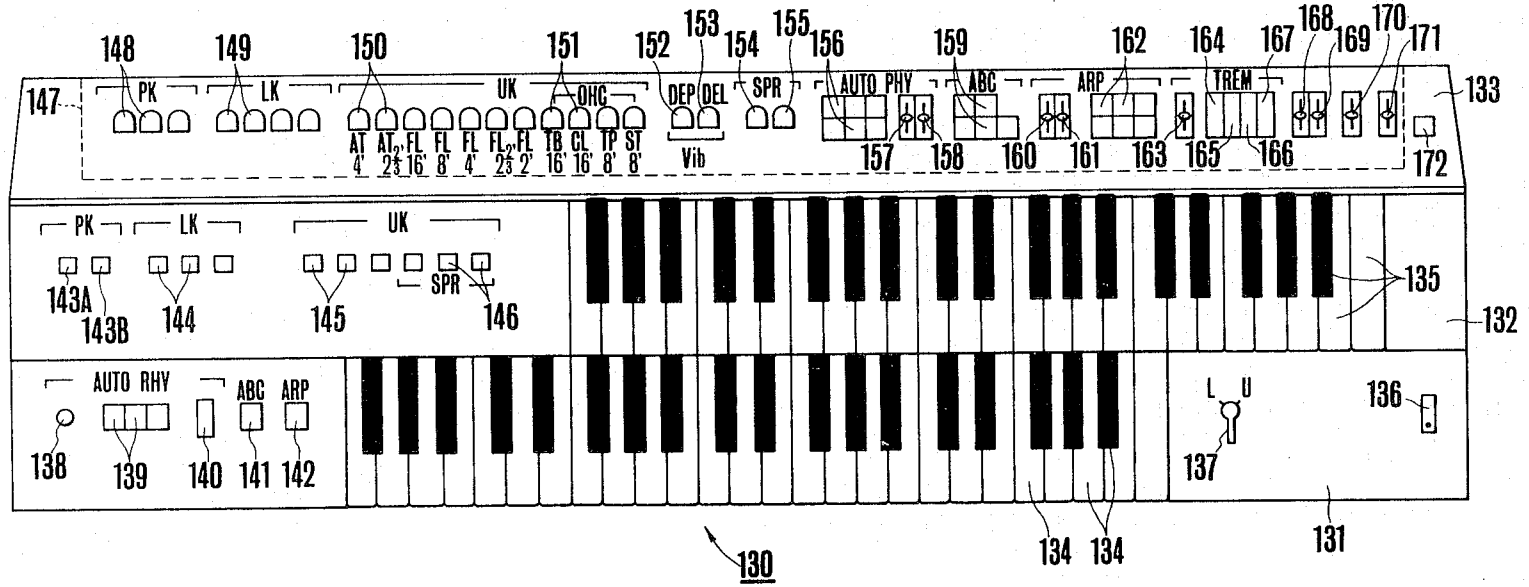
FIG. 6 is a front view of the panel board of a modified electronic musical instrument embodying the invention.

FIG. 6 shows a panel surface arrangement of a modified electronic musical instrument according to this invention which comprises the main body 130 of the musical instrument, including a lower stage panel 131, a middle stage panel 132 and an upper stage panel 133.

A lower keyboard (LK) 134 is mounted on the lower stage panel 131 and an upper keyboard (UK) 135 is mounted on the middle panel 132. Furthermore, a plurality of operating members are mounted on these panels 131 and 132. More particularly, on the right hand portion of the lower stage panel 131 are arranged a source switch 136 and a U(UK)/L(LK) manual balancing variable resistor 137, while on the left hand portion of the lower stage panel are arranged a tempo adjusting variable resistor 138 for an auto-rhythm (AUT RHY), three rhythm selection switches 139 for selecting such extremely simple tones (small variation) as two beats, three beats, four beats etc., a switch 140 for instructing the start of the auto-rhythm, a switch 141 for designating a preset autobass/chord (ABC) of a simple form, and a switch 142 for designating a preset auto-arpeggio (ARP) of a simple form.

On the left hand portion of the middle stage panel 132 are mounted a bass tone selection switch 143A and a base guitar tone selection switch 143B regarding the PK tone, three tone color selection switches 144 regarding the LK tone, three tone color selection switches 145 regarding the UK tone, and three tone color switches 146 regarding a special preset. The tone colors selectable by the tone color selection switches 144 are of organ fashion (that is organ like), orchestra fashion (that is orchestra like) and jazz fashion (that is jazz like), and the tone colors selectable by the tone color selection switches 146 are a piano I, a piano II and a vibraphone.

Furthermore, on the upper stage panel 133 are provided a plurality of operating members 148 through 171 belonging to a blind unit 147 and a preset release switch 172. By constructing the blind unit 147 similar to that described above a plurality of operating units 148 through 171 are normally concealed.

Among the operating members belonging to the blind unit are included three tone volume adjusting variable resistors 148 regarding the PK tone (bass 16', bass 8' and base guitar), four (piano I, piano II, guitar and harpsichord) tone volume adjusting variable resistors 149 concerning the LK tone, seven AT4', AT2⅔', FL16', FL8', FL4', FL2⅔' and FL2') tone volume adjusting variable resistors 150 concerning the flute tone, four (TB16', CL16', TP8' and ST8') tone volume adjusting variable resistors 151 concerning the orchestra UK tone, a depth adjusting variable resistor 152 and a delay time (DEL) adjusting variable resistor 153 concerning the vibrato (Vib) effect, a U/L transfer switch 154 and a volume adjusting variable resistor 155 concerning a special preset, six rhythm selection switches 156 concerning the auto-rhythm, a volume adjusting variable resistor 157 and a balance adjusting variable resistor 158, five (one finger, custom, fingered chord, constant, memory) mode selection switches 159 concerning the auto-bass/chord, a sustain length adjusting variable resistor 160 concerning arpeggio (ARP), a volume adjusting variable resistor 161, a mode selection switch 162, a modulation speed adjusting variable resistor 163 concerning the tremolo (TREM) effect, a modulation speed (SLOW or FAST) setting variable resistor 164, an LK tone designation switch 165, an orchestra UK tone designation switch 166, a flute UK tone designation switch 167, a UK tone sustain length adjusting variable resistor 168, a PK sustain length adjusting variable resistor 169, a reverb depth adjusting variable resistor 170 and a master volume adjusting variable resistor 171.

When the blind unit 147 is closed these operating members are not seen, and even when the blind unit is opened, their operations are invalid unless the preset is released by operating the preset release switch 172. More particularly, when the preset is not released (i.e. in the case of the preset) it is possible to perform an auto-rhythm, an auto-bass/chord or an auto-arpeggio of a relatively simple preset type by a suitable manipulation of the operating members 138 through 142 provided for the lower stage panel 131. It is also possible to control a musical tone according to a desired preset information by a suitable manipulation of the operating members 143A, 143B, 144, 145 and 146 provided for the middle stage panel but impossible to control the musical tone according to a control information set by the blind unit. To this end, it is necessary to release the preset (transfer to the manual mode). When the preset is released the performer operates the operating members 148 through 171 of the blind unit 147 to set various tone colors.

Figure 7:
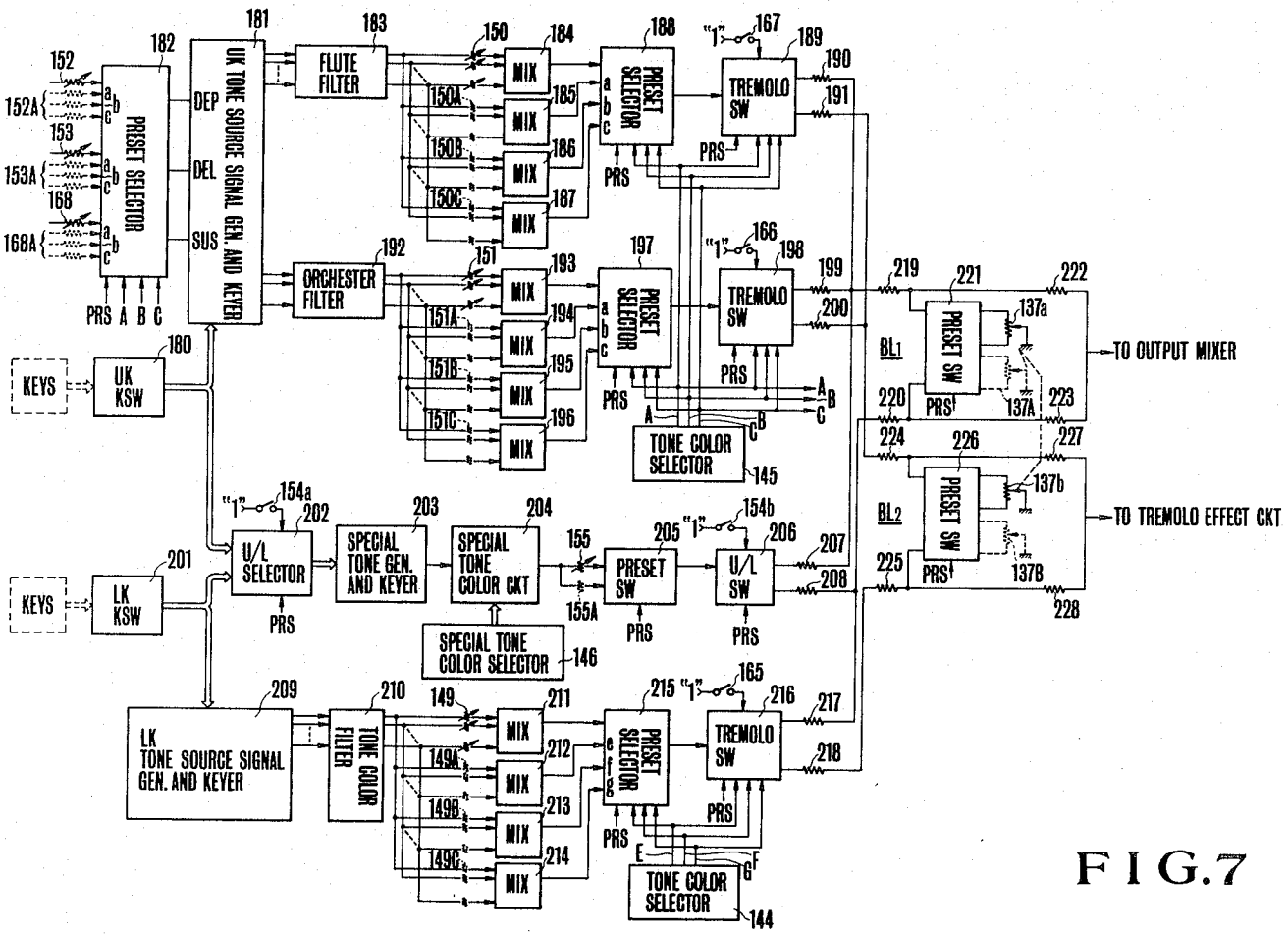
FIG. 7 is a connection diagram showing portions relating to a manual keyboard of the musical tone forming and controlling unit of the electronic musical instrument shown in FIG. 6.
Figure 8:
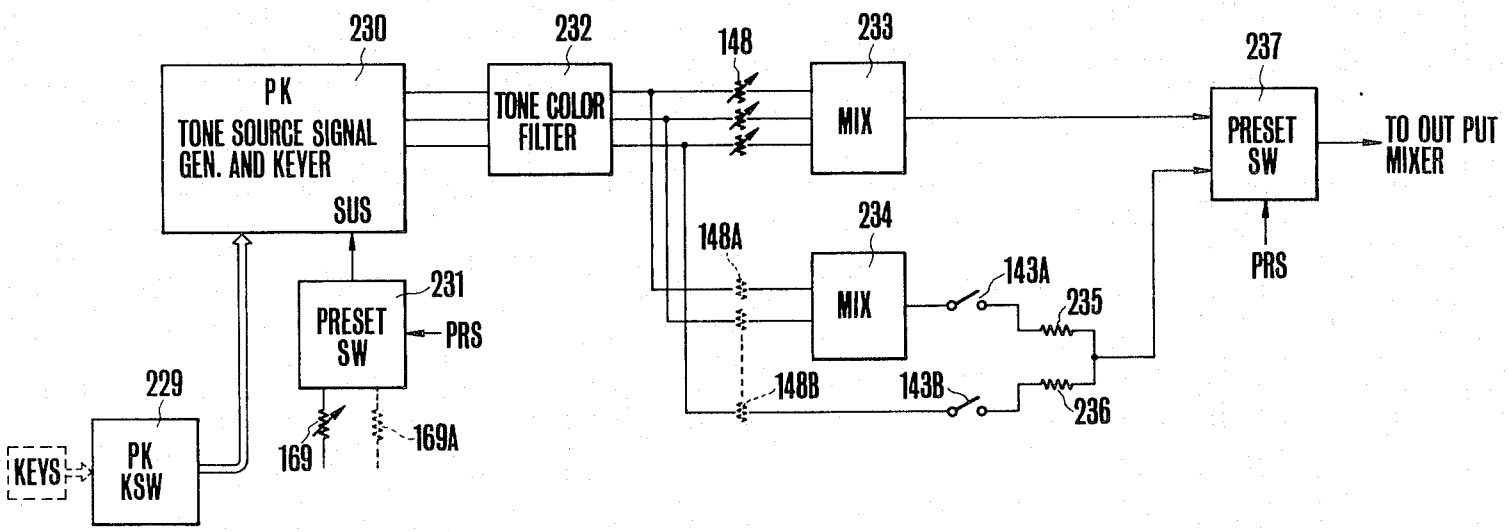
FIG. 8 is a connection diagram showing a pedal keyboard of the musical tone and controlling unit of the electronic musical instrument shown in FIG. 6.

The musical tone forming and control unit of the electronic musical instrument shown in FIG. 6 will now be described with reference to FIGS. 7 and 8. FIG. 7 shows circuit elements relating to the UK and LK while FIG. 8 shows circuit elements relating to the PK. In these figures, since a portion for forming a preset signal PRS, portions regarding the auto-bass/chord, the auto-arpeggio, and the auto-rhythm, and the output mixer, the expression device, the master volume adjusting device and the sound system which follow the reverb device and the tremolo effect circuit are identical to those shown in FIGS. 4 and 5 they are omitted.

In FIG. 7, there is provided a key switch circuit 180 corresponding to UK keyboard 135 described above and operates to apply a key state signal representing a depressed key of the upper keyboard UK to a tone source switching circuit 181 which comprises a tone source unit that generates a tone source signal having a frequency corresponding to all keys of the upper keyboard UK, and a switch unit which derives out the tone source signal generated by the tone source unit according to a key state signal from the key switch circuit 180. The tone source unit is provided with a vibrato effect circuit which subjects the tone source signal to frequency modulation with a vibrato modulation low frequency signal.

A preset selector 182 is provided for supplying to the tone source signal generation circuit and keyer 181 a control signal for designating the sustain time of the envelope, a control signal for designating the depth of the vibrato, and a control signal that designates the delay time DEL of the vibrate. The inputs of the preset selector 182 are applied with voltage signals from the variable resistors 152, 153 and 168 on the panel surface, and the voltage signals from the presetting fixed resistors 152A, 153A and 168A. The fixed resistors 152A, 153A and 168A include three resistors for each set corresponding to three preset tone colors (organ fashion, orchestra fashion and jazz fashion) regarding the upper keyborard and voltage signals are supplied to the input terminals a, b and c of each set. The signal selection operation of the preset selector 182 is controlled by the preset signal PRS and the tone color designation signals A, B and C from a tone color selection circuit 145, the tone color designation signals A, B and C designating the organ fashion, orchestra fashion and jazz fashion respectively.

Assume now that the preset signal PRS is "1" to establish a preset mode, the selector 182 is in a state to send out the voltage signals from the fixed resistors 152A, 153A and 168A. When an organ fashion designation signal A is "1", corresponding voltage signals are applied to the input terminal a of each set of the fixed resistors 152A, 153A and 168A, whereas when the orchestra fashion tone color designation signal B is "1" corresponding voltage signals are applied to input b of each set of the fixed resistors 152A, 153A and 168A. When the jazz fashion tone color designation signal C is "1", corresponding voltage signals are applied to the input terminal c of each set of fixed resistors 152A, 153A and 168A. Accordingly, in this case, the vibrate depth DEP, the vibrato delay time DEL and the sustain time SUS are determined according to the preset voltages from the fixed resistors 152A, 153A and 168A respectively.

When the preset signal PRS becomes "0" to change the state to the manual mode, the above described controls effected by the tone color designation signals A, B and C become invalid, but instead the voltage signals from the variable resistors 152, 153, and 168 on the panel surface are produced by the selector 182. For this reason, the vibrato depth DEP, the vibrato delay time DEL and the sustain time would be determined by the set voltages from variable resistors 152, 153 and 168.

The output signal from the tone source signal generation circuit and keyer 181 is applied to the flute filter circuit 183 for respective footage to form respective tone colors by filters corresponding to AT4', AT2⅔', FL16', FL8', FL4', FL2⅔' and FL2'. On the output side of the filter circuit 183 are connected tone volume adjusting resistors 150 for respective tone colors of AT4', AT2⅔', FL16' through FL2' and the musical tone signals from the filter circuit 183 are supplied to a flute mixer 184 respectively through corresponding tone volume adjusting variable resistor 150 to be admixed. Consequently, the mixer 184 produces a musical tone signal corresponding to the settings of the tone volume adjusting variable resistors 150. Further, the musical tone signal from the filter 183 is applied to a mixer 185 via presetting resistors 150A for respective tone colors, the resistance values of the resistors being determined to emphasize the organ fashion tone color and to another mixer 186 via presetting fixed resistors 150B for respective tone colors, the resistance values of the resistors 150B being determined to emphasize the orchestra fashion tone color. Further, the musical tone signal produced by the filter 183 is applied to a mixer 187 via presetting fixed resistors 150C for respective tone colors having resistance values selected to emphasize the jazz fashion tone color. For this reason, the mixers 185, 186 and 187 produce musical tone signals whose tone colors have been emphasized for organ fashion, orchestra fashion and jazz fashion, respectively.

The flute musical tone signal produced by the mixer 184 is applied to a preset selector 188, while the musical tone signals produced by mixers 185, 186 and 187 respectively are applied to input terminals a, b and c of a selector 188 which selects the input signals in accordance with the tone color designation signals A, B and C from the tone color selection switch 145 for producing musical tone signals supplied to corresponding input terminals a, b and c in the case of the preset mode wherein the preset signal is "1" and the tone designation signals are all "1", whereas in the case of the manual mode in which the preset signal PRS is "0" produces the musical tone signal from the mixer 184. More particularly, in the case of the preset mode, an organ fashion musical tone signal from the mixer 185, an orchestra fashion musical signal from the mixer 186 and a jazz fashion musical tone signal from the mixer 187 are selected when the tone color designation signals A, B and C respectively designate the tone color of the organ fashion, orchestra fashion and jazz fashion, whereas in the case of the manual mode, the flute musical tone signal from the mixer 184 is selected. In this manner, the musical tone signal selected by the selector 188 is applied to a tremolo switching circuit 189.

The purpose of the tremolo switching circuit 187 is to impart a tremolo effect or not and this circuit 189 operates in response to the preset signal PRS, the tone color designation signals A, B and C and a state signal from the flute UK tone designation switch regarding the tremolo. More particularly, in the case of the preset mode wherein the preset signal is "1", a musical tone signal inputted to the tremolo switching circuit 189 is supplied via a resistor 190 when either one of the tone color designation signals A, B and C is set to "1". In the case of the manual mode wherein the preset signal is "0", the input musical tone signal would be sent out through the resistor 190 whereas through a resistor 191 when the designation switch 167 is closed and when its state signal is "1". In these cases the musical tone signal sent out through the resistor 190 is not intended for imparting the tremolo effect whereas the musical tone signal sent out through the resistor 191 is intended for imparting the tremolo effect.

The output signal from the tone source signal generation circuit and keyer 181 is also applied to an orchestra fashion tone color filter circuit 192 for respective feet rates, and respective tone colors are formed by filters corresponding to respective tone colors of TB16', CL16', TP8' and ST8'. The musical tone signal produced by the filter circuit 192 is supplied to a mixer 193 via tone volume adjusting variable resistors 151 provided for respective tone colors and then mixed together. The musical tone signal produced by the filter circuit 192 is applied to a mixer 194 via presetting fixed resistors for respective tone colors, the values of these fixed resistors being determined to emphasize the organ fashion tone color, to a mixer 195 via presetting fixed resistors 151B for respective tone colors, the values of the resistors being determined to emphasize the orchestra fashion tone color, and also to a mixer 196 via presetting fixed resistors 151C for respective tone colors, the values of the resistors 151C being set to emphasize the jazz fashion tone color.

The musical tone signals produced by the mixers 193 through 196 are applied to a preset selector 197 for selecting the signals in the same manner as the selector 188 described above. As a consequence, in the case of the preset mode, the selector 197 sends out the musical tone signals from the mixers, 194, 195 and 196 each time the tone color designation signals A, B and C produced by the tone color selection switch 145 designate the tone colors of the organ, orchestra and jazz fashions, whereas in the case of the manual mode, sends out an orchestra musical tone signal from the mixer 193.

The musical tone signal from the selector 197 is applied to a tremolo switching circuit 198 which operates in the same manner as the tremolo switching circuit 189 described above. In the case of the preset mode in which the preset signal is "1", the tremolo switching circuit 198 sends out a musical tone signal via a resistor 199 when either one of the tone color designation signals A, B and C is set to "1" whereas in the case of the manual mode wherein the preset signal is "0", sends out a musical tone signal via the resistor 199 if the orchestra UK tone designation switch 166 were OFF, but when this switch is ON, sends out the musical signal via a resistor 200. The musical signal sent out through the resistor 199 is not intended to impart the tremolo effect, whereas the musical tone signal sent out through the resistor 200 is intended to impart the tremolo effect.

A circuit for forming a special musical tone signal will now be described. A U/L selector 202 has one input supplied with a key state signal from the UK key switch circuit 180 and the other input supplied with a key state signal from an LK key switch circuit 201 so that during the preset mode wherein the preset signal PRS is "1", the selector 200 produces the key state signal from the UK key switch circuit 180 independently of the U/L transfer switch 154. But in the case of the manual mode wherein the preset signal is "0", the U/L selector 202 derives out the key state signal from the UK key switch circuit 180 or the LK key switch circuit 201 in response to a state signal "0" or "1" from one (in this case 154*a*) of the interlocked switch elements 154*a* and 154*b* of the U/L transfer switch 154. The key state signal sent out from the selector 202 is applied to a special tone source signal generation circuit and keyer 203.

This keyer 203 is constructed to send out a musical tone signal corresponding to a depressed key of the upper keyboard UK or the lower keyboard LK, and its output signal is applied to a special tone color circuit 204 to form a musical tone. The tone color mode of the special tone color circuit 204 is controlled by the special tone color selection switch 146 so as to form the tone colors of a piano, a harpsichord, a vibraphone, etc. For this reason, the tone color circuit 204 produces a musical tone signal having a tone color designated by the tone color selection switch 141 and the musical tone signal thus produced is applied to a preset switching circuit 205 in-parallely through the volume adjusting variable resistors 155 and the presetting fixed resistors 155A.

The preset switching circuit 205 operates to select the musical signal from the resistors 155 or 155A in accordance with the preset signal PRS. Thus, in the case of the preset mode wherein the preset signal is "1", the musical tone signal from the fixed resistors 155A is selected, whereas in the case of the manual mode wherein the preset signal is "0", the musical tone signal from the variable resistors 155 is selected. The musical tone signal produced by the preset switching circuit 205 is supplied to the U/L switching circuit 206.

In the case of the preset mode, the U/L switching circuit 206 sends out the inputted signal through a resistor 207 and during the manual mode, sends out the inputted musical signal via resistor 207 or 208 depending upon whether the state signal from the switch element 154*b* interlocked with the switch element 154*a* is "0" or "1", this switching operation corresponding to that of the U/L selector 202 described above. More particularly, in the case of the preset or manual mode and when the switch elements 154*a* and 154*b* are open, the U/L switching circuit 206 applies to a resistor 207 a special musical signal concerning the upper keyboard UK when the U/L selector 202 selects a UK key state signal, whereas when the switch elements 154*a* and 154*b* are closed during the manual mode, the U/L switching circuit 206 sends out a special musical tone signal regarding the lower keyboard LK through a resistor 208 when the U/L selector selects an LK key state signal. The UK special musical tone signal derived out through the resistor 207 is mixed with the UK musical tone signals produced by resistors 190 and 199 and an LK special musical tone signal derived out through a resistor 208 is mixed with an LK musical signal to be described later.

The circuit adapted to form an LK musical tone is as follows. A tone source signal generation circuit and keyer 209 supplied with a key state signal from the LK key switch circuit 201 comprises a tone source unit which produces a tone source signal having a frequency corresponding to all keys of the lower keyboard, a switching unit for opening and closing the tone source signal generated by the tone source unit according to the key state signal from the key switch circuit 201, an auto-bass/chord circuit and an auto-arpeggio circuit.

An output signal produced by a tone source signal generation circuit and keyer 209 is supplied to a tone color filter circuit 210 to form tone colors of the piano I, the piano II, the guitar and the harpsichord. The musical tone signal from the tone color filter circuit 210 is applied to and admixed by a mixer 211 via tone volume adjusting variable resistors provided for respective tone colors. The musical tone signal produced by the filter circuit 210 is also supplied to a mixer 212 via presetting fixed resistors 149A, the values thereof being determined to emphasize the organ fashion tone color, to a mixer 213 via the presetting resistors 149B for respective tone colors, the values of the resistors 149B being determined to emphasize the orchestra fashion tone color, and to a mixer 214 via presetting fixed resistors 213 for respective tone colors, the values of the resistors 149C being selected to emphasize the jazz fashion tone color.

The musical tone signals from the mixers 211 through 214 are applied to a preset selector 215 to select the signals in the same manner as the selector 188. As a consequence, in the case of the preset mode, each time the tone designation signals E, F and G from the tone selection switch 144 designate the tone colors of the organ, orchestra and jazz fashions, the selector 215 sends out from its output terminals the musical tone signals applied to its input e, f and g from the mixers 212, 213 and 214 respectively, whereas in the case of the manual mode, the selector 215 sends out the musical tone signal from the mixer 211.

The musical tone signal from the selector 215 is sent to a tremolo switch circuit 216 which operates in the same manner as the above described tremolo switching circuit 189. In the case of the preset mode wherein the present signal PRS is "1", the tremolo switching circuit 216 sends out a musical tone signal whenever either one of the tone designation signals E, F and G is set to "1", whereas in the case of the manual mode wherein the preset signal PRS is "0", sends out a musical signal via resistor 217 when the LK tone designation switch 165 is OFF, but through resistor 218 when the switch 165 is closed. The musical tone signal sent out through the resistor 217 is not intended to impart the tremolo effect, whereas the musical tone signal sent out through the resistor 218 is intended to impart the tremolo effect.

Each of the flute UK musical tone signal sent out through the resistor 190, the orchestra UK musical tone signal sent out through the resistor 199 and the UK special musical tone signal sent out through the resistor 207 is not intended to impart the tremolo effect so that they are mixed together by a resistor 219 and then applied to a U/L balance adjusting circuit $BL_1$. On the other hand, the special musical tone signal sent out through the resistor 208 and the LK musical tone signal sent out through the resistor 217 are intended to impart the tremolo effect so that they are mixed together by a resistor 220 and then supplied to the U/L balance adjusting circuit $BL_1$.

The U/L balance adjusting circuit $BL_1$ includes a preset switching circuit 221 which selectively connect to it one (in this example 137*a*) of mutually interlocked variable resistance elements 137*a* and 137*b* of the manual balance adjusting resistor 137, and the presetting fixed resistor 137A in accordance with the preset signal PRS. During the preset mode in which the preset signal PRS is "1", the semifixed (or fixed) resistor 137A sets the U/L balance, whereas during the manual mode in which the preset signal is "0", the variable resistance element 137*a* controls the U/L balance. The UK musical tone signal and the LK musical tone signal whose balances have been adjusted are derived out respectively through resistors 222 and 223 and then mixed together for application to an output mixer, not shown.

Each of the flute UK musical tone signal derived out through the resistor 191, and the orchestra UK musical tone signal sent out through the resistor 200 is intended to impart the tremolo effect so that these signals are applied to a U/L balance adjusting circuit $BL_2$ via a resistor 224. Also the LK musical tone signal derived out through the resistor 218 is intended to impart the tremolo effect so that it is supplied to the U/L balance adjusting circuit $BL_2$.

The U/L balance adjusting circuit $BL_2$ includes the other variable resistance element 137*b* of the manual balance adjusting resistor 137, the presetting fixed resistor 137B, and a preset switching circuit 226 which selectively connect the resistance element 137*b* and the resistor 137B to the U/L balance adjusting circuit $BL_2$ in accordance with the preset signal PRS. During the preset mode wherein the preset signal is "1", the semifixed (or fixed) resistor 137B sets the U/L balance, whereas during the manual mode in which the preset signal is "0", the variable resistor 137*b* controls the U/L balance. The UK and LK musical tone signals whose balances have been adjusted are derived out respectively through resistors 227 and 228, mixed together and then applied to a tremolo effect circuit, not shown.

Turning now to FIG. 8, a musical tone forming and control unit of the pedal keyboard PK will be described. A key switch circuit 229 corresponding to the pedal keyboard PK supplies a key state signal indication of a depressed pedal key to a musical tone source signal generation keyer 230 which is constituted by a tone source unit for generating a tone source signal having a frequency corresponding to all pedal keys and a switch unit for deriving out the tone source signal generated by the tone source unit according to the key state signal from the key switch circuit 229 in addition to an auto-bass/chord circuit and an auto-arpeggio circuit. When operating the switch unit, the length of the sustain time SUS of the envelope is controlled by the output signal of the preset switching circuit 231 which in response to the preset signal selectively outputs the voltage signal from the variable resistor 169 on the panel surface or the presetting fixed resistor 169A. As a consequence in the preset mode in which the preset signal PRS is "1" the sustain time SUS is determined by the voltage from the fixed resistor 169A, whereas the manual mode wherein the preset signal is "0", the sustain time SUS is determined by the voltage set by the variable voltage.

The output signal from the tone source switching circuit 230 is supplied to a tone color filter circuit 232 to form the tone color of the bass 16', bass 8', the bass guitar and the like. The musical tone signals generated by the tone color filter circuit 232 and corresponding to the bass 16', bass 8', and the bass guitar are applied to a mixer 233 via tone volume adjusting variable resistors 148 provided for respective colors to be mixed together. The other musical tone signals corresponding to the bass 16', the bass 8' etc. are supplied to a bass mixer 234 through corresponding presetting fixed resistors 148A to be mixed together. A musical tone signal corresponding to the bass guitar is derived out via a presetting fixed resistor 148B. A mixed musical tone signal from the mixer 234 is supplied to a resistor 235 via a bass tone selection switch 143A while a musical tone signal from the presetting fixed resistor 148B is applied to a resistor 236 via a bass guitar tone selection switch 143B. When the bass tone selection switch 143A is closed, a musical tone signal corresponding to a mixed bass tone is applied to a preset switching circuit 237 via a resistor 235, whereas when the bass/guitar tone selection switch 143B is closed a musical tone signal corresponding to the bass guitar tone is applied to the preset switching circuit 237 via a resistor 236. When both selection switches 143A and 143B are closed, a musical tone signal corresponding to the mixed bass tone and a musical tone signal corresponding to the bass guitar tone are supplied concurrently to the preset switching circuit 237 via resistors 235 and 236 respectively. In addition to the musical signals described above, a musical tone signal from the mixer 233 is also applied to the preset switching circuit.

The switching operation of the preset switching circuit 237 is controlled by the preset signal PRS and during the preset mode wherein the preset signal is "1", a musical signal supplied through resistor 235 and or 236 is derived out whereas in the case of the manual mode in which the preset signal is "0", a musical tone signal supplied from the mixer 233 would be derived out. The musical tone signal from the preset switching circuit 237 is supplied to an output mixer not shown.

Like the previous embodiment, with the electronic musical instrument shown in FIGS. 6 to 8, it is possible to perform two types of performances, i.e., the preset mode and the manual mode, so that not only unskilled but also skilled performers can readily enjoy the electronic musical instrument. Moreover, according to these embodiments, since a plurality of sets of tone color control information are set to be selectable, when performing the preset mode, the freedom of the tone color selection is increased thus providing an additional advantage of avoiding a single color.

It should be understood that the invention is not limited to the specific embodiments described above and that many variations and modifications may be made within the scope of the invention. For example, switching from the preset mode to the manual mode and vice versa can be made automatically in relation to the release and operation of the blind unit.

Further, instead of using a mechanical switch for releasing the preset, a touch switch or a voice switch can also be used. Also instead of transferring the preset value and the manual value with a switch it is also possible to effect the same transfer action by enabling or disabling a preset value setting member and a manual setting member.

It should also be understood that the present invention is not limited to an analogue electronic musical instrument and that it is also applicable to a digital electronic musical instrument.

What is claimed is:

1. An electronic musical instrument comprising:

a power source for supplying power to said instrument;

a keyboard having a plurality of keys;

means for controlling manners of tone production; and means coupled to said control means for forming a musical tone corresponding to a depressed key;

said control means including:

a plurality of manually operated members for manually setting parameters that determine said manners and mounted on a control panel;

means for presetting one or more of said parameters;

means for automatically coupling, at the time said power source is turned on, said preset parameters to said musical tone forming means irrespective of said manually operated members and;

means for substituting said manually set parameters for said preset parameters to be coupled to said musical tone forming means at a time after said turn-on time of said power source.

2. An electronic musical instrument according to claim 1 wherein said preset parameters coupling means and said manually set parameters substituting means comprise:

a transfer switch interposed between said presetting means and said manually setting means; a preset parameters release switch; and coupling control means which causes said transfer switch to couple said presetting means to said musical tone forming means at said turn-on time of said power source and to couple said manually setting means to said musical tone forming means in accordance with an operation of said preset parameters releasing switch after said turn-on time of said power source.

3. An electronic musical instrument according to claim 2 wherein said coupling control means comprises:

a memory means which stores a first operation of said preset release switch after said turn-on time of said power source;

means for causing said memory means to couple said manually setting means to said musical tone forming means via said transfer switch in response to an output from said memory means caused by said operation, said memory means storing a second operation of said preset release switch; and means for causing said memory means to couple said presetting means to said musical tone forming means via said transfer switch in response to an output of said memory means outputted therefrom in response to said second operation.

4. An electronic musical instrument according to claim 1 wherein said control panel includes means for normally concealing said operating members.

* * * * *